United States Patent [19]

Fushimi

[11] Patent Number: 5,055,882

[45] Date of Patent: Oct. 8, 1991

[54] DEVELOPING AGENT DISPERSING UNIT FOR AN IMAGE FORMING APPARATUS

[75] Inventor: Seiichiro Fushimi, Kanagawa, Japan

[73] Assignee: Kabushiki Kaisha Toshiba, Kawasaki, Japan

[21] Appl. No.: 473,725

[22] Filed: Feb. 2, 1990

[30] Foreign Application Priority Data

Feb. 13, 1989 [JP] Japan ..... 1-031015

[51] Int. Cl.[5] ..... G03G 15/24

[52] U.S. Cl. ..... 355/269; 355/270; 355/296

[58] Field of Search ..... 355/296, 269, 270, 245, 355/303, 297, 299, 215; 118/651-653

[56] References Cited

U.S. PATENT DOCUMENTS

| | | | |
|---|---|---|---|
| 4,129,072 | 12/1978 | Fujii et al. | 355/269 X |
| 4,311,780 | 1/1982 | Mochizuki et al. | 355/296 X |
| 4,648,705 | 3/1987 | Tachibana et al. | 355/299 X |
| 4,769,676 | 9/1988 | Mukai et al. | 355/269 |

FOREIGN PATENT DOCUMENTS

| | | | |
|---|---|---|---|
| 0342798 | 11/1989 | European Pat. Off. | 355/269 |
| 0282875 | 12/1986 | Japan | 355/270 |

*Primary Examiner*—A. T. Grimley
*Assistant Examiner*—William J. Royer
*Attorney, Agent, or Firm*—Foley & Lardner

[57] ABSTRACT

An image forming apparatus has a developing device for simultaneously developing a charged pattern with developing agent into a developed image on an image carrier and removing developing agent remaining on the image carrier from a previous image forming operation from portions of the image carrier other than the developed image. The developed image is transferred from the image carrier to a recording medium. The image forming apparatus also has a dispersing unit for dispersing any developing agent remaining on the image carrier after the transfer of the developed image, the dispersing unit including at least two brush members spaced each other in sliding contact with the image carrier. A guide plate is mounted on the dispersing unit, to guide the recording medium to the brush members.

2 Claims, 5 Drawing Sheets

DEVELOPING AGENT DISPERSING UNIT FOR AN IMAGE FORMING APPARATUS

BACKGROUND OF THE INVENTION

1. Field of the Invention

The present invention relates to an image forming apparatus in which a cleaning means cleans off toner remaining on an image carrier after a visible image has been transferred from the image carrier onto a recording medium.

2. Description of the Related Art

In an image forming apparatus of the electrophotographic type, such as a laser beam printer, there is provided a developing device that effects conversion of an electrostatic latent image into a visible image by supplying toner onto the electrostatic latent image formed on a cylindrical photosensitive body constituting an image carrier. Further, there is provided an image transferring device that transfers the visible image onto a paper as a recording medium from the cylindrical photosensitive body. Most of the toner on the photosensitive body is transferred onto the paper by this transfer device, however some of the toner is left behind on the photosensitive body.

As shown in FIG. 1, this toner may be left behind on the photosensitive body after image transfer in various ways. A shows the normal transfer process. B is similar to the normal transfer process, however, as a result of somewhat excessive transfer, the toner is given a charge of opposite polarity i.e. a positive charge, produced by the transfer charger. This is likely to occur when solid black areas etc. are transferred. C is a case where poor image transfer leaves behind lumps of toner. This is likely to occur when the paper is separated from the photosensitive body due to carrier adhesion from paper creasing during transfer. The toner remaining in unexposed areas after transfer is electrostatically attracted to the developing device since the surface potential $V_0$ of the photosensitive body is lower than the developing bias Vb that is applied to the developing device. In contrast, toner left behind in the exposed areas after transfer, being negatively charged toner, does not return to the developing device but is left behind on the photosensitive body, since the surface potential of the photosensitve body is increased by exposure. A method of cleaning the photosensitive body by electrostatically attracting the remained toner from the photosensitive body to the developing device is thoroughly described in U.S. Pat. No. 4,769,676.

If residual toner is left behind on the photosensitive body after transfer as in cases A and B, where the toner is uniformly dispersed over the photosensitive body, the residual toner does not effect the next image formation. Because the amount of light provided by the laser in the exposing step is large and the exposed area is large in relation to the size of the toner, the exposure is not obstructed by such toner adhering to the photosensitive body. Therefore, the latent image can be formed by decay of the negative potential of the surface of the photosensitive body. Furthermore, there is no difficulty at all in the formation of the latent image, due to the effective cleaning by the developing device, as described above, in the unexposed areas. However, in case C, where lumps of toner are left behind, the developing device has difficulty in cleaning away all this toner, and "positive memories" are formed on white backgrounds. And in cases where these portions correspond to subsequently exposed areas, the toner layer becomes a thick lump of large diameter, preventing the passage of light and resulting in negative memories on black backgrounds.

In order to remove such toner left behind after transfer as described above, conventionally, a cleaner was provided at the periphery of the photosensitive body, between the transfer charger and the discharge lamp. This cleaner conventionally consisted of a blade that contacted the surface of the photosensitive body to scrape off residual toner, and a recovery box in which this scraped-off toner was recovered.

However, with the conventional cleaner as described above, since it employs a construction wherein the residual toner left behind on the photosensitive body was scraped away by a blade into a recovery box, carrying out 2,000 to 3,000 copies would normally result in the recovery box being filled with toner, and so becoming unusable. For this reason, complicated recovery mechanisms and recovery boxes were provided and the toner had to be recovered by changing the recovery box each time. However, these mechanisms were of complicated construction, and operability was poor, in that they soiled the hands or clothes of the user. In some machines, the cleaner had to be thrown away every time the recovery box became full. Furthermore, due to use of a blade to scrape away the toner from the photosensitive body, the surface of the photosensitive body was damaged. A further problem was that, if paper got caught between the blade and the surface of the photosensitive body, proper feeding of the paper was prevented.

U.S. Pat. No. 4,769,676 discloses a dispersing device for dispersing the residual toner remaining on a photosensitive drum after the transfer of the developed image and before the next image forming operation. The dispersing device is composed with a conductive brush which is in sliding contact with the photosensitive drum. By sliding contact conductive brush with photosensitive drum, the strewing of residual toner is effected.

However, since the dispersing device disclosed in U.S. Pat. No. 4,769,676 is composed with only one conductive brush, a toner retaining capability on the conductive brush is small. Therefore, although the residual toner is attracted to the conductive brush, since the residual toner is separated at once from the conductive brush, a toner dispersing capability is small. As a result, the residual toner is unfortunately transferred on the next recording medium in the next image forming operation.

SUMMARY OF THE INVENTION

It is an object of the present invention to provide an image forming apparatus wherein the effects of toner left behind on an image carrier during exposure are prevented by a simple construction to improve the image quality on a recording medium.

According to the present invention, an image forming apparatus, including an image carrier, utilizing a developing agent for forming an image on a recording medium comprises means for forming a charged pattern corresponding to the image on the image carrier; means for simultaneously developing the charged pattern with developing agent into a developed image on the image carrier and removing developing agent remaining on the image carrier from a previous image forming operation from portions of the image carrier other than the developed image; means for transferring the developed image from the image carrier to the recording medium; and means for dispersing any developing agent remaining on the image carrier after the transfer of the developed image, the dispersing means including at least two brush members spaced apart from each other in sliding contact with the image carrier.

DETAILED DESCRIPTION OF THE PREFERRED EMBODIMENT

Referring to the accompanying drawings, a detailed description will subsequently be given of the preferred embodiment of the present invention.

Figure 1:
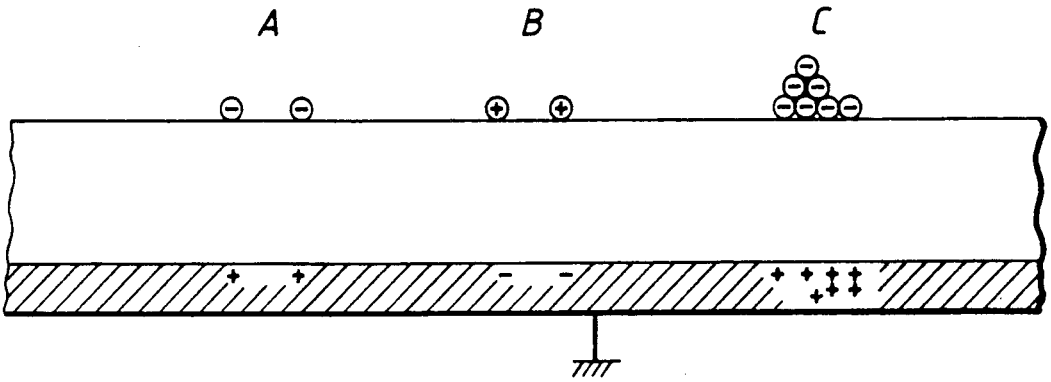
FIG. 1 is a represantaion showing how the toner is left behind on the image carrier.
Figure 2:
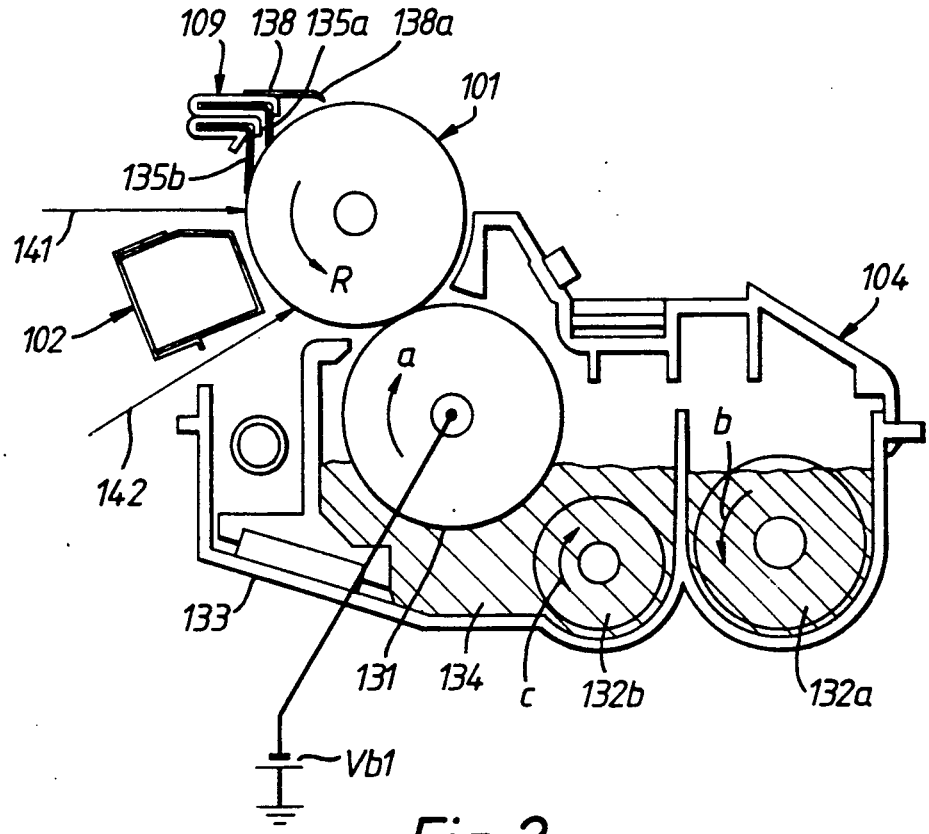
FIG. 2 is a vertical cross-sectional view showing main parts of an image forming apparatus according to an embodiment of the present invention.
Figure 3:
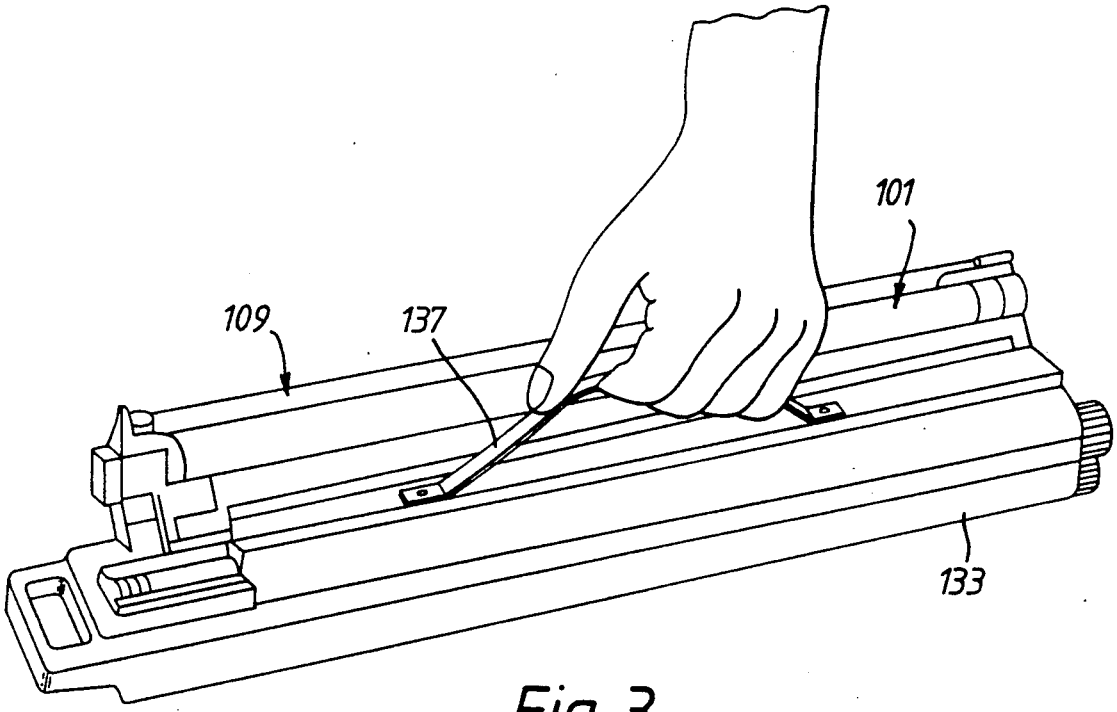
FIG. 3 is a perspective view showing the main parts of the image forming apparatus shown in FIG. 2.
Figure 4:
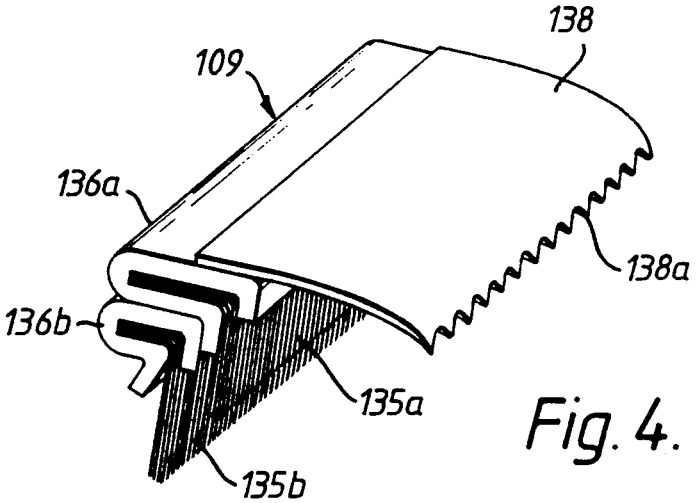
FIG. 4 is a perspective view showing a toner dispersion means shown in FIG. 2.

FIGS. 2 to 5 show an embodiment of the present invention. In FIG. 2, a single magnet roller 131 and a pair of agitate rollers 132*a* and 132*b* are arranged within a casing 133 of a developing device 104 with their respective axis parallel to each other. A negative voltage $Vb_1$ of −DC 300 V as a bias voltage is applied to magnet roller 131. These rollers 131, 132*a* and 132*b* are driven in rotation in the directions of respective arrows a, b, and c by a drive source (not shown). Toner 134 constituting the developer is contained in casing 133. In casing 133, a drum shaped photosensitive body 101 is provided parallel to rollers 131, 132*a* and 132*b*, and is driven in rotation in the direction of arrow R by a drive source (not shown). Furthermore, in casing 133, a dispersing means 109 is provided parallel to photosensitive body 101. On this dispersing means 109, as shown in FIG. 4, a pair of brushes 135*a* and 135*b*, which are held by a pair of holders 136*a* and 136*b*, are arranged in parallel with each other and are formed of a soft member such as electrically conductive rayon. The bottom ends of brushes 135*a* and 135*b* are in sliding contact along the direction of the generatrix, with the surface of photosensitive body 101. The widths of brushes 135*a* and 135*b* are greater than the maximum width of paper that is used, and greater than the width of the image region. A paper conveying guide plate 138 formed with an indentation part 138*a* at its bottom end is mounted on holder 136*a* parallel to brush 135*a*, above brush 135*a* on the upstream side in the direction of rotation of photosensitive body 101. Indentation part 138*a* of paper conveying guide plate 138 closes to the surface of photosensitive body 101 to prevent paper from being caught between brushes 135*a* and 135*b* and the surface of photosensitive body 101. A positive voltage $Vb_2$ of +DC 400 V is applied to downstream-side brush 135*b*.

Figure 5:
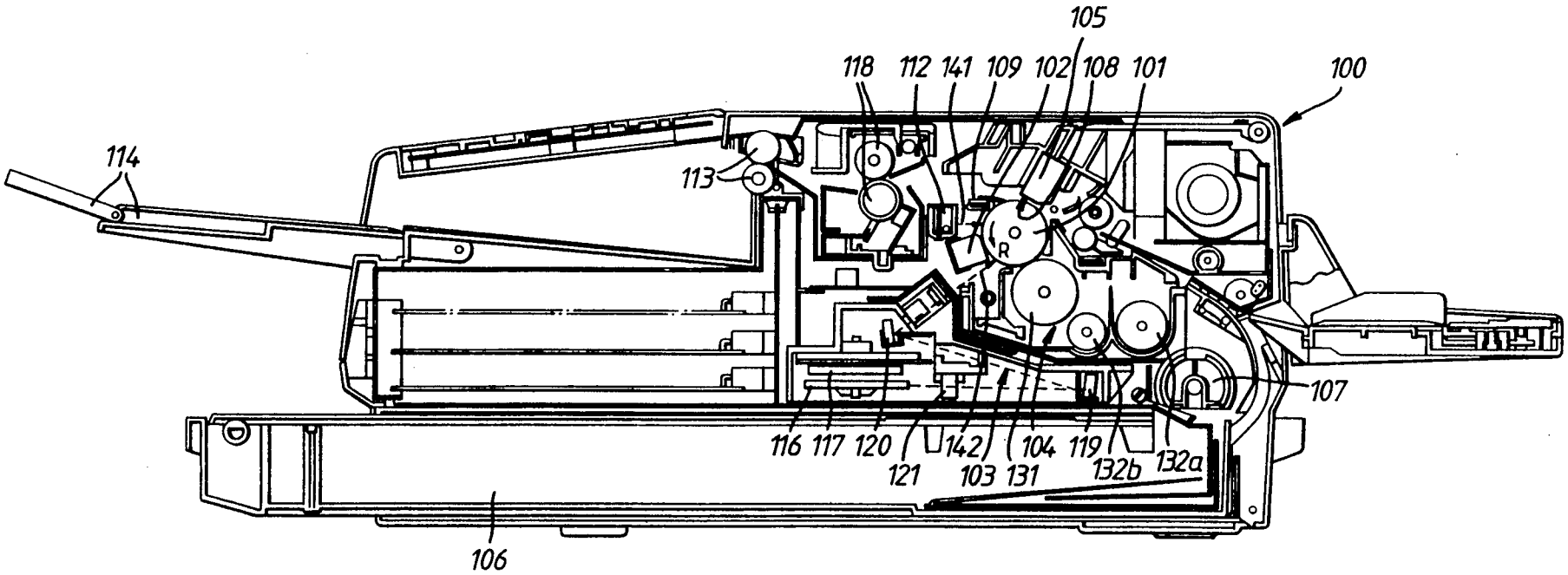
FIG. 5 is a vertical cross-sectional view showing a laser printer to which a toner dispersion means according to this embodiment has been applied.

In FIGS. 2 and 5, reference numeral 141 denotes the position of incidence of the light directed onto the photosensitive body 101 from a discharge lamp 112. Reference numeral 142 denotes the position of incidence of the laser beam directed onto the photosensitive body 101 from a electrostatic latent image forming station 103 (described later). A handle 137 is mounted on casing 133 of developing device 104, as shown in FIG. 3.

Next, an embodiment of the present invention applied to a laser beam printer will be described with reference to FIG. 5. FIG. 5 shows a construction of a monochromatic laser beam printer of the electrophotographic type. This laser beam printer is electrically coupled, through a transmission device (not shown) to a host system (external device) such as a computer or word processor. The beam printer receives dot image data from the external device and uses this data to modulate the laser beam which then forms electrostatic latent images on the photosensitive body. The electrostatic latent images are developed to convert visible images and transferred onto the paper.

Within a main body 100, a drum-shaped photosensitive body 101 is arranged, which is rotated in the direction of arrow R by a drive source (not shown).

At the circumference of photosensitive body 101, there are arranged in sequence along the direction of rotation a main charger 102 of controlled charging type, electrostatic latent image forming station 103, developing device 104 provided with dispersing means 109, a transfer charger 105, and discharge lamp 112. Photosensitive body 101 is integrally constructed with developing device 104. Developing device 104 performs simultaneously developing and cleaning of photosensitive body 101.

A paper supply cassette 106 is provided in main body 100. The paper, used as a recording medium, is extracted from paper supply cassette 106 by a paper feed roller 107, and is fed between photosensitive body 101 and transfer charger 105. After passing through a transferring station 108 and a fixing unit 118, the paper is then fed to a pair of exit rollers 113, and discharged to a paper discharging station 114.

Electrostatic latent image forming station 103 comprises a semiconductor laser oscillator such as a laser diode (not shown) that generates a laser beam modulated in response to dot image data from an external device (not shown); a lens system (not shown) such as a collimator lens that focuses the laser beam that is output from this laser oscillator; a rotating mirror (polygonal mirror) 116 having, for example, four faces that scan the laser beam that is focused by this lens system; a mirror motor 117 that rotates this rotating mirror 116 at high speed; a lens 121 that directs the laser beam scanned by rotating mirror 116 correctly onto photosensitive body 101; reflecting mirrors 119 and 120 that reflect the laser beam in the direction of photosensitive body 101; and a beam detector (not shown) that detects the laser beam that is scanned by rotating mirror 116.

When the start-printing signal from the external device is received, photosensitive body 101 is rotated, and photosensitive body 101 is uniformly charged up to a surface potential of, for example, approximately −600 V by main charger 102. Next, when the dot image data is received from the external device, electrostatic latent image forming station 103 outputs a laser beam modulated in response to this dot image data, and an electrostatic latent image is formed on the surface of photosensitive body 101 by scanning exposure of the charged surface of photosensitive body 101 using this laser beam. The electrostatic latent image formed on photosensitive body 101 is developed with reversal developing by developing device 104 having magnetic roller 131 and agitate rollers 132*a* and 132*b*, to produce a toner image. In transferring station 108, the toner image on photosensitive body 101 is then transferred onto the paper fed from paper supply cassette 106.

The paper onto which the toner image has been transferred is then fed to fixing unit 118 to fix this toner image. The paper is then discharged to paper discharging station 114 by exit rollers 113. The residual toner that is left on photosensitive body 101 after the toner image has been transferred to the paper from photosensitive body 101 by transfer charger 105 is then dispersed on the surface of photosensitive body 101 by dispersing means 109 by an operation to be described later. Next, the surface of photosensitive body 101 is uniformly discharged by means of light from discharge lamp 112 such as a red LED.

The operation of dispersing means 109 will be described with reference to FIGS. 6 to 11.

Figure 6:
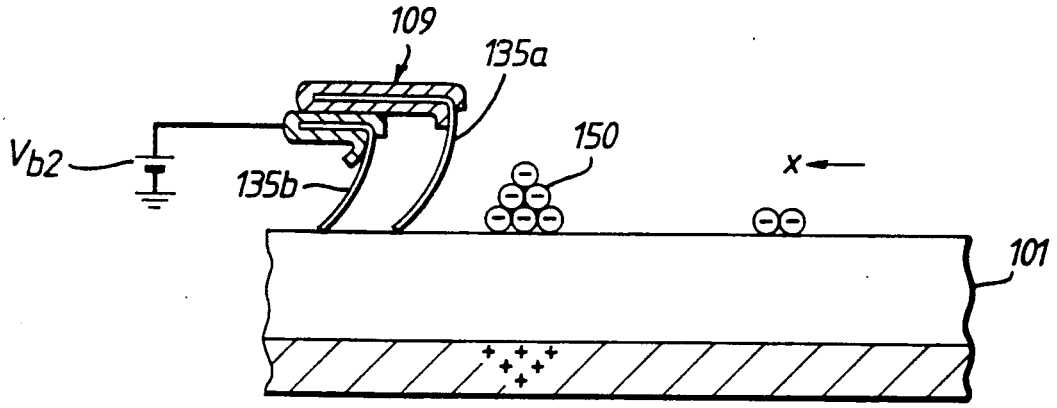
FIGS. 6 to 11 are diagrams showing the operation of this embodiment.
Figure 7:
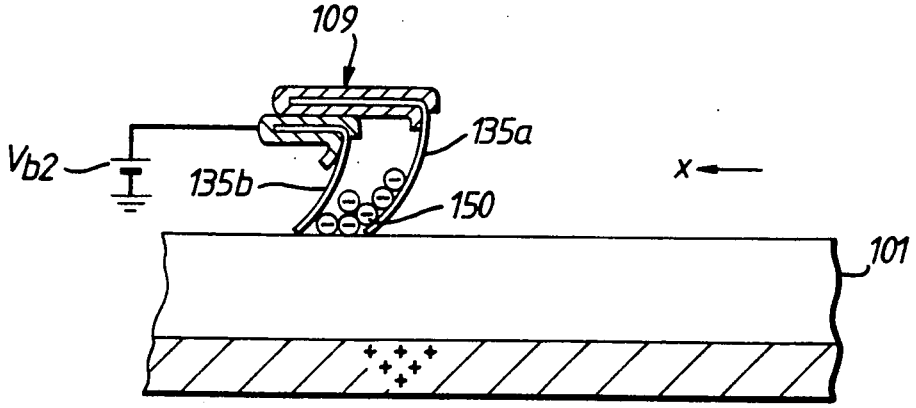
Figure 8:
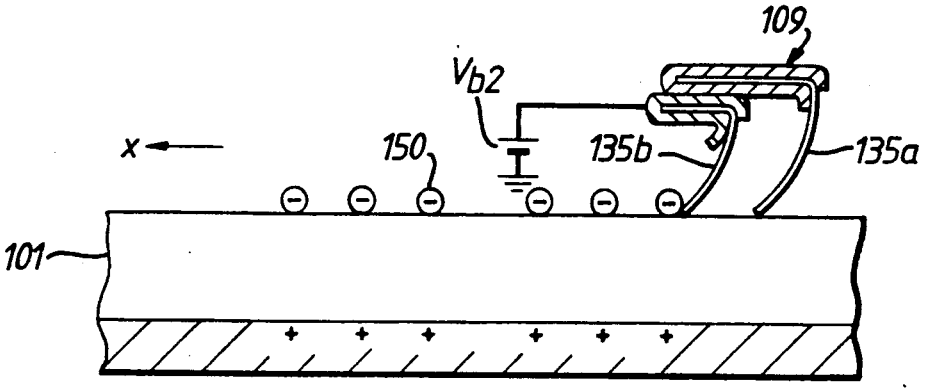
Figure 9:
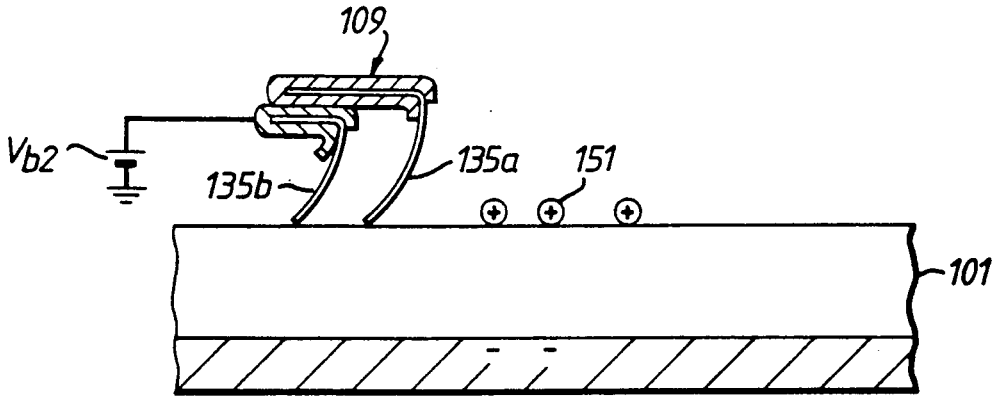
Figure 10:
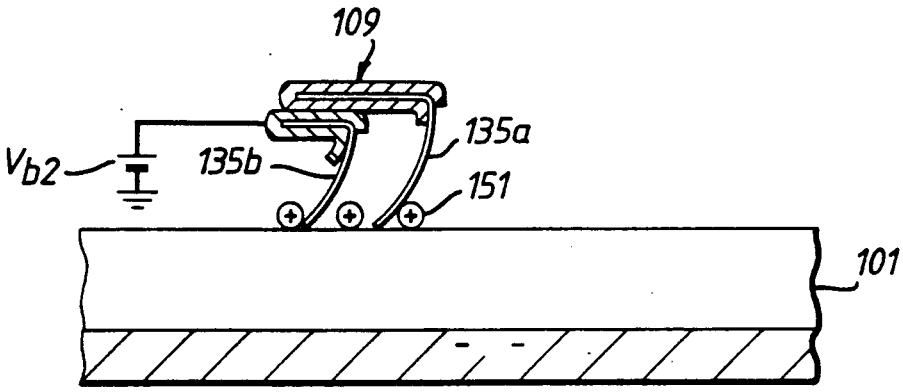
Figure 11:
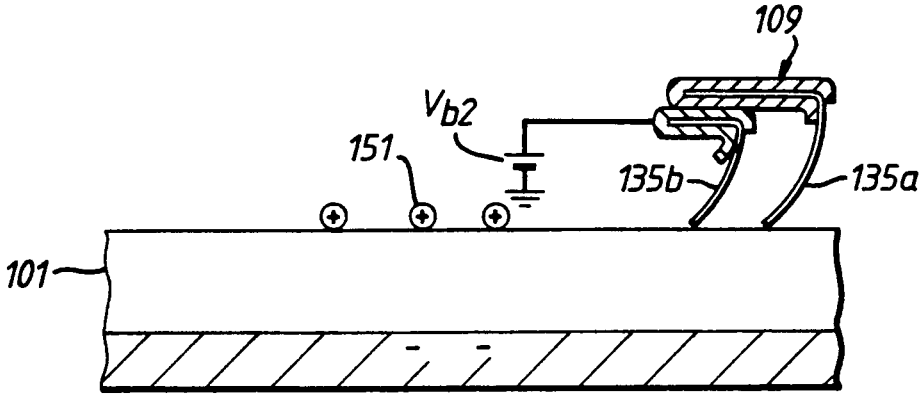

FIGS. 6 to 8 show the case where insufficient toner is transferred from photosensitive body 101 onto the paper, that is, where a large amount of residual toner remains on photosensitive body 101. FIGS. 9 to 11 show the case where excess toner is transferred from photosensitive body 101 onto the paper, that is, where a small amount of residual toner remaines on photosensitive body 101. If, as shown in FIG. 6, there is a toner lump 150 on the surface of photosensitive body 101 moving in the direction of arrow X, this toner lump 150 is smoothed out when it passes underneath brush 135*a* on the upstream side. Next, as shown in FIG. 7, toner lump 150 having a minus charge insufficient for transfer is attracted to brush 135*b*, to which a positive voltage is applied. When photosensitive body 101 advances further in the direction of arrow X, owing to the absence of a toner retaining capability on brush 135*b*, toner lump 150 that was previously attracted to brush 135*b* is naturally discharged at the rear of brush 135*b* as shown in FIG. 8. Although toner lump 150, which has remained on photosensitive body 101, is attracted to brush 135*b* by electrostatic force, since the amount of toner which can be held on brush 135*b* is small, and since brush 135*b* is in contact with photosensitive body 101 in the same direction as the rotation of photosensitive body 101, toner 150 that was temporarily attracted to it is gradually deposited over other parts of the surface of photosensitive body 101. That is, toner lump 150 is strewed over a wide area on the surface of photosensitive body 101. The toner 150 strewed on photosensitive body 101 transfers to magnetic roller 131 to which the bias voltage of DC −300 V is applied, as a result, photosensitive body 101 is cleaned off so that no fogging occurs on the second copy image.

In contrast, in the case of excess toner transfer, that is, a small amount of residual toner remains on photosensitive body 101, as shown in FIG. 9. The toner 151 is uniformly dispersed on photosensitive body 101, and the polarity of the toner 151 is inverted, so that the toner 151 has a positive plurality, like that of brush 135*b*. Thus, although photosensitive body 101 advances in the direction of arrow X and passes below brush 135*b* as shown in FIG. 10, such toner is not attracted but remains adhering to photosensitive body 101 as this advances. That is, as shown in FIG. 11, toner 151 passes unaffected below brushes 135*a* and 135*b* and lies in the same position on photosensitive body 101 as it was before passage. Since brush 135*b* is formed of a soft member, and is in contact with photosensitive body 101 in the same direction as the rotation of photosensitive body 101, its contact pressure is extremely weak, so there is no possibility of toner 151 being displaced. Toner 151 therefore remains uniformly dispersed. The toner 151 uniformly dispersed on photosensitive body 101 transfers to magnetic roller 131 to which the bias voltage of DC −300 V is applied. As a result, photosensitive body 101 is cleaned off, so that no fogging occurs on the second copy image.

In this process, the paper that passes between photosensitive body 101 and transferring station 108 is fed in the direction of exit rollers 113 whilst being guided by paper conveying guide plate 138, so there is no possibility of its being caught between photosensitive body 101 and brushes 135*a* and 135*b*. Also, since paper conveying guide plate 138 closes to the surface of photosensitive body 101 without contact, there is no possibility of its scraping and disturbing toner 150 and 151.

According to the above embodiment, residual toner 150 and 151 on photosensitive body 101 is in each case uniformly dispersed after passing under brushes 135*a* and 135*b*, so the production of a residual image by the residual toner 150 and 151 from the first image forming operation on exposure in the second image forming operation can be prevented. Therefore, the toner recovery box which was hitherto needed is unnecessary, and photosensitive body 101, developing device 104 and dispersing means 109 can be integrated as a cartridge, thereby enabling the size and weight of the device as a whole to be reduced.

The above embodiment was described for the case where two brushes 135*a* and 135*b* are provided in dispersing means 109. However, the number of such brushes 135*a* and 135*b* could be three or more. Also, the members of dispersing means 109 are not restricted to brushes, but could be blades or sponge-form members etc.

Various other modifications could be made in the present invention without departing from the scope or spirit of the following claims.

What is claimed is:

1. An image forming apparatus utilizing a developing agent for forming an image on a recording medium, comprising:

a rotatable image carrier;

charging means for charging the image carrier;

exposure means for exposing the rotatable image carrier to form a latent image corresponding to the image on the image carrier;

developing/removing means for simultaneously developing the latent image with developing agent into a developed image on the image carrier and removing developing agent remaining on the image carrier from a previous image forming operation from portions of the image carrier other than the developed image;

transfer means for transferring the developed image from the image carrier to the recording medium; and disperse means for dispersing any developing agent remaining on the image carrier after transfer of the developed image, the disperse means including at least two electrically conductive brush members spaced apart from each other in sliding contact with the image carrier and a voltage source connected to one of the brush members for attracting the developing agent remaining on the image carrier;

the charging means, exposure means, developing-/removing means, transfer means and disperse means being arranged in sequence along the direction of rotation of the image carrier.

2. An image forming apparatus utilizing a developing agent for forming an image on a recording medium comprising:

a rotatable image carrier;

charging means for charging the image carrier;

exposure means for exposing the rotatable image carrier to form a latent image corresponding to the image on the image carrier;

developing/removing means for simultaneously developing the latent image with developing agent into a developed image on the image carrier and removing any developing agent remaining on the image carrier from a previous image forming operation from portions of the image carrier other than the developed image;

transfer means for transferring the developed image from the image carrier to the recording medium;

disperse means for dispersing any developing agent remaining on the image carrier after the transfer of the developed image, the disperse means including at least two electrically conductive brush members spaced apart from each other in sliding contact with the image carrier and a voltage source connected to one of the brush members for attracting the developing agent remaining on the image carrier; and guide means mounted to the disperse means for guiding the recording medium on which the developed image has transferred from the image carrier by the transfer means;

whereby the charging means, exposure means, developing/removing means, transfer means and disperse means with guide means being arranged in sequence along the rotational direction of the image carrier.

* * * * *